US007874476B2

(12) United States Patent
D'Amato

(10) Patent No.: US 7,874,476 B2
(45) Date of Patent: Jan. 25, 2011

(54) CONTAINER AND BLANK FOR THE PRODUCTION THEREOF

(75) Inventor: Gianfranco D'Amato, Arzano Napoli (IT)

(73) Assignee: Seda S.p.A., Arzano Napoli (IT)

( * ) Notice: Subject to any disclaimer, the term of this patent is extended or adjusted under 35 U.S.C. 154(b) by 116 days.

(21) Appl. No.: 12/067,085

(22) PCT Filed: Sep. 14, 2006

(86) PCT No.: PCT/EP2006/008985

§ 371 (c)(1),
(2), (4) Date: Sep. 17, 2008

(87) PCT Pub. No.: WO2007/033796

PCT Pub. Date: Mar. 29, 2007

(65) Prior Publication Data

US 2009/0032575 A1 Feb. 5, 2009

(30) Foreign Application Priority Data

Sep. 19, 2005 (DE) ..... 20 2005 014 737 U

(51) Int. Cl.
*B65D 5/50* (2006.01)
*B65D 5/20* (2006.01)

(52) U.S. Cl. ..... 229/122.34; 229/114; 229/120.18; 229/146; 229/173; 229/906

(58) Field of Classification Search ..... 229/114, 229/120.18, 122.32, 122.34, 173, 902, 906, 229/146; 426/115
See application file for complete search history.

(56) References Cited

U.S. PATENT DOCUMENTS 1,466,344 A * 8/1923 Sardou ..... 229/120.17
1,899,772 A 2/1933 Richardson
2,341,928 A * 2/1944 Levkoff ..... 229/173
2,692,722 A 10/1954 Johnson (Continued)

FOREIGN PATENT DOCUMENTS

DE 1737771 U 1/1957

(Continued)

OTHER PUBLICATIONS

International Search Report mailed Nov. 17, 2006 in PCT/EP2006/008984.

(Continued)

*Primary Examiner*—Gary E Elkins
(74) *Attorney, Agent, or Firm*—Fish & Richardson P.C.

(57) ABSTRACT

A container (1) for the transport of a foodstuff comprises an upper and a lower container half (2, 3) which are interconnected for pivoting between a closed and an open position (4). Each container half comprises a flat bottom and/or cover wall (5, 6), from which side walls (7, 8, 9, 10) extend essentially obliquely upwards or downwards and outwards to the respective other container half (2, 3). In order to improve the thermal insulation with containers of this nature and at the same time to achieve increased stability, in particular with containers made from paper, cardboard or the like, the bottom and/or cover wall (5, 6) is formed double-walled at least in places. A one-part blank (40) is provided for the manufacture of a container of this nature.

22 Claims, 2 Drawing Sheets

U.S. PATENT DOCUMENTS

Figure 1:
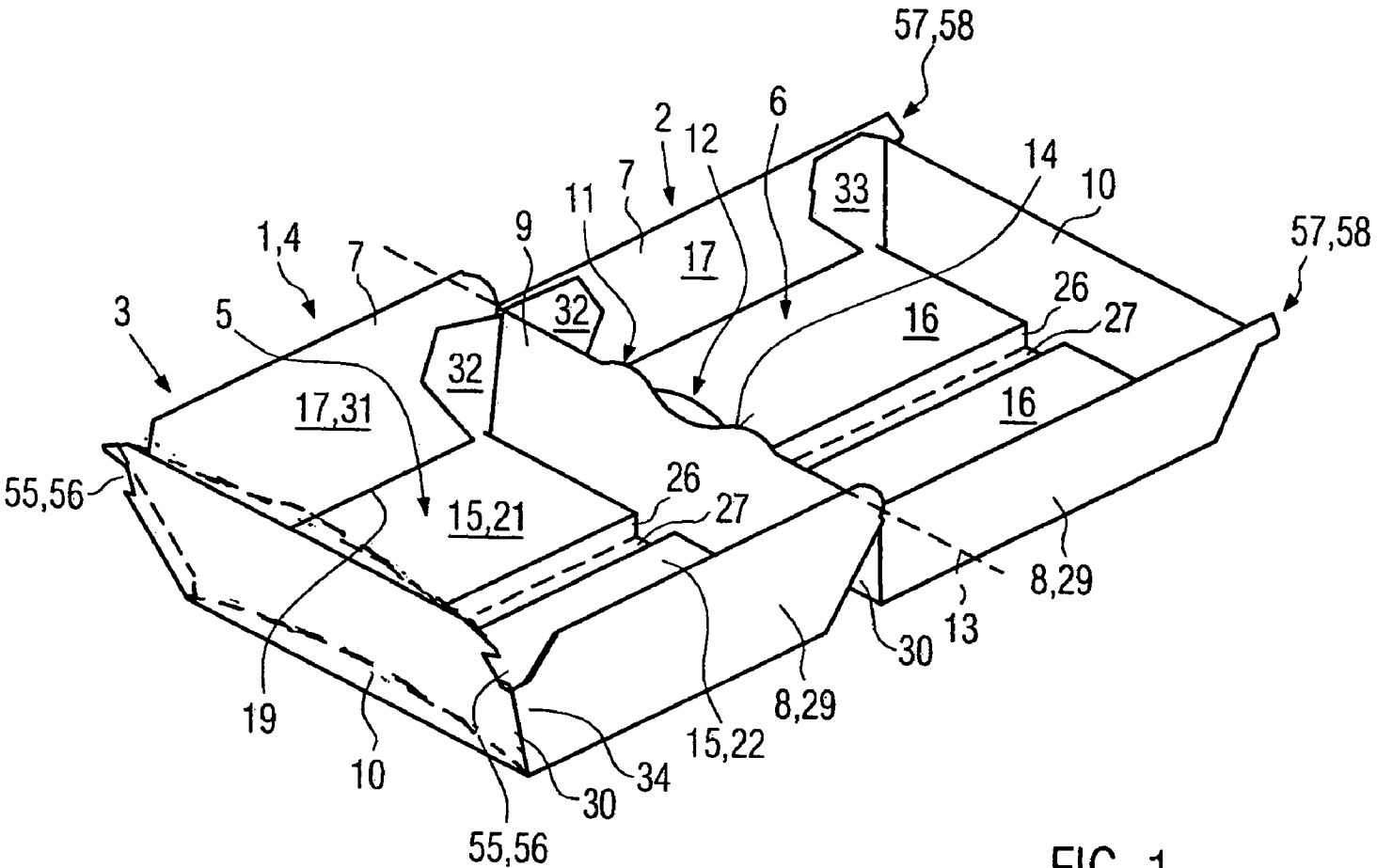

| | | | | | |
|---|---|---|---|---|---|
| 2,832,465 | A | | 4/1958 | Vuillemenot | |
| 2,847,117 | A | | 8/1958 | Vuillemenot | |
| 2,924,372 | A | * | 2/1960 | Kirkeby | 229/904 |
| 2,982,465 | A | | 5/1961 | Fallert | |
| 2,983,428 | A | * | 5/1961 | Bess | 229/173 |
| 3,124,293 | A | | 3/1964 | Transport | |
| 3,217,968 | A | * | 11/1965 | Clarke | 229/114 |
| 3,258,380 | A | * | 6/1966 | Fischer et al. | 229/931 |
| 3,343,660 | A | | 9/1967 | Bailey | |
| 3,541,599 | A | | 11/1970 | Ramshaw et al. | |
| 4,034,908 | A | * | 7/1977 | Forbes et al. | 229/120.18 |
| 4,267,959 | A | | 5/1981 | Gilbert | |
| 4,360,147 | A | | 11/1982 | Brauner | |
| 4,763,832 | A | | 8/1988 | Forbes, Jr. | |
| 4,844,330 | A | | 7/1989 | Roosa et al. | |
| 5,188,284 | A | | 2/1993 | Eisman | |
| 5,205,476 | A | | 4/1993 | Sorenson | |
| 5,332,147 | A | * | 7/1994 | Sorenson | 229/114 |
| 5,335,845 | A | * | 8/1994 | Liu | 229/120.18 |
| 5,388,758 | A | * | 2/1995 | Scovell | 229/114 |
| 5,520,324 | A | | 5/1996 | Cai | |
| 5,553,772 | A | | 9/1996 | Jensen | |
| 5,603,450 | A | | 2/1997 | Whitnell | |
| 5,615,796 | A | * | 4/1997 | Rench | 229/906 |
| 5,718,370 | A | * | 2/1998 | Lafferty et al. | 229/120.18 |
| 5,788,145 | A | | 8/1998 | Grahahm et al. | |
| 5,826,781 | A | | 10/1998 | Jensen | |
| 5,848,699 | A | * | 12/1998 | Pettersson | 229/114 |
| 5,909,840 | A | * | 6/1999 | Schultheiss | 229/114 |
| 6,283,364 | B1 | | 9/2001 | Gray, Sr. | |
| 6,332,538 | B1 | | 12/2001 | Pritchard et al. | |
| 6,863,212 | B2 | | 3/2005 | Stone et al. | |
| 7,097,043 | B2 | * | 8/2006 | Hsu | 229/120.18 |
| 2002/0000463 | A1 | * | 1/2002 | Jaggi | 229/173 |
| 2003/0136820 | A1 | * | 7/2003 | Negelen | 229/240 |

FOREIGN PATENT DOCUMENTS

| | | |
|---|---|---|
| DE | 2001499 | 7/1970 |
| DE | 9203448 U1 | 8/1992 |
| DE | 202005006072 | 9/2006 |
| FR | 2043987 | 2/1971 |
| GB | 2359295 | 8/2001 |

OTHER PUBLICATIONS

International Search Report mailed Feb. 2, 2007 PCT/EP2006/008985.

* cited by examiner

CONTAINER AND BLANK FOR THE PRODUCTION THEREOF

RELATED APPLICATIONS

This application is a nationalization of PCT application No. PCT/EP2006/008985 filed on Sep. 14, 2006, claiming priority based on German No. 20 2005 014.0 filed on Sep. 19, 2005, the contents of which are incorporated herein by reference in their entirety.

The invention relates to a container with an upper and a lower container half, which are connected together in a pivotable manner in order to pivot between a closed and an open position, each container half comprising a flat bottom and/or cover wall and side walls extending therefrom essentially obliquely outwards and upwards and/or downwards to the respective other container half.

A container of this nature is for example known for storing a hamburger or the like. After placement of the hamburger into the container it is closed by pivoting the upper container opening into the closed position and can be carried by the consumer. Sometimes carrying only takes place over a few metres or for a short time from a suitable sales point for the hamburger to a means of seating. Then the container is opened again by pivoting the upper container half into the open position and the hamburger is removed completely from the container for consumption.

Often however, the container is taken to a more remote place or optionally also to the consumer's residence so that consumption occurs only after ten, fifteen or more minutes after purchase. Although suitable containers, in particular of a foam plastic material, in part already offer a certain thermal insulation, containers of this nature are expensive in comparison for example to containers of paper, cardboard or the like and in particular are also less favourable for recycling.

The object of the invention is therefore to improve a container of the type mentioned in the introduction such that it has better thermal insulation and at the same time, in particular with containers of paper, cardboard or the like, that they have increased stability.

This object is solved by the characterising elements of Claim 1.

In particular the invention is characterised in that at least in places the bottom and/or cover wall is formed double-walled. Due to this double-walled feature, on one hand an improved thermal insulation is produced by air chambers that are formed and on the other hand increased stability is produced through the use of a first and second bottom and/or cover wall.

In this connection it may be sufficient if only the cover wall is double-walled, because the corresponding container is generally arranged with its bottom wall on a substrate, in a bag or in some other transport container or the like, by means of which a certain thermal insulation is produced in the region of the bottom wall.

Various possibilities are conceivable for obtaining a double-walled feature of this nature. In principle there is the possibility of simply arranging a second bottom wall above the first bottom wall or correspondingly a second cover wall below the first cover wall with appropriate spacing elements between them, wherein the appropriate air chambers for thermal insulation are formed between the respective walls and the spacing elements which may also be optionally formed with them on one side.

In order to realise the pivoting feature of the upper container half relative to the lower container half in a simple manner, oppositely situated side walls of the container halves can be joined together in a pivoting manner as pivoting side walls in particular essentially along their free end edges, forming a pivot line.

In order in this connection to simplify opening and closing the container, the pivot line can have a central sectional line along the free end edges. In this way the resistance, in particular on opening the upper container half, is reduced without the thermal insulation of the container being negatively affected by the appropriate sectional line.

To prevent the straight cut edges of the sectional line from coming together and impeding the opening of the container halves, the sectional line can be essentially formed undulated.

The thermal insulation of the container can be further improved in this way if at least the side walls adjoining the pivot side walls are formed double-walled. There is also the possibility of forming all the side walls double-walled.

In order to form the corresponding second bottom and/or cover wall in a simple manner, it can extend between two opposite, in particular double-walled, side walls. In achieving this, the joining of these second walls can occur directly only with the corresponding side walls without a further joint to the other two side walls being necessary.

In order to join the corresponding second walls in a simple manner to these opposite side walls and in this way to also simplify the manufacture of the container, the second bottom and/or cover wall can be joined particularly to the lower ends of the inner wall sections which are folded towards the container interior and pertain to the opposite side walls.

In order to here ensure that contact of the first and second walls to the foodstuff located in the container is largely avoided and essentially the air chamber is formed completely between the first and second walls, the lower ends of the inner wall sections can be arranged spaced to the first bottom and/or cover wall. In this way it is ensured that at least in the region of these lower ends no contact to the first and second walls occurs. In addition, the distance can in this connection be selected so large or the second walls can be held under an appropriately large tension between the other side walls, such that also no contact between the first and second walls occurs approximately centrally to the respective bottom and/or side walls.

In order to be able to manufacture the container simply, the second bottom and/or side wall can be formed from interconnected partial walls projecting from opposite inner wall sections. In this way the partial walls are continuations of the corresponding inner wall sections and are in particular joined to their lower ends. Then joining the partial walls together occurs in a manner such that, where possible, a continuous air chamber is formed between the first and second walls of the respective bottom and cover.

A joint of this nature can for example be implemented in that the partial walls are joined together along their end sections which are oriented towards one another. A joint of this nature can be realised by gluing.

In order to stiffen each of the second walls in this connection, the end sections can be formed step-shaped from essentially vertical and horizontal step walls, wherein in particular the horizontal step walls are joined together by gluing or the like.

Also here there is the possibility that the partial walls are not in contact with the respective first wall of the bottom or cover also in the region of their interconnected step walls.

However, in order to further increase the stiffness of the container and to ensure the greatest possible air space between the first and second walls of the bottom and the cover, an appropriate horizontal step wall can be in contact with the inner side of the corresponding first bottom and/or cover wall and in particular it can be glued there. The respective other horizontal step wall is then glued to the further horizontal step wall opposite the first wall of the bottom or cover, so that in this region essentially a three-layer structure is formed, which ensures adequate thermal insulation in this region even on contact of the first and second wall. In particular in this connection it should be noted that the appropriate foodstuff is not in contact with the horizontal step wall, but that by the horizontal step walls connected to one another and the adjoining vertical step walls a trough or groove is formed, which itself forms an air chamber for thermal insulation and in particular prevents contact of the foodstuff directly with the horizontal step walls or the first wall of the bottom or cover.

In order to facilitate closure of the container in a simple manner, a side wall, in particular opposite the pivot side wall, can be formed as a closing side wall, the closing side wall of the lower container half being detachably connected to the upper container half in the closed position.

In order to ensure a reliable interconnection of the various side Walls and to further increase the stability of the container, adhesive flanges, connected to the inner sides of the other side walls, can project from the side ends of the pivot side walls and/or closing side walls.

Another means of increasing the stability of the container can be obtained when at least the closing side wall of the upper and lower container halves are bent inwards in a concave manner.

In order to not just increase the stability further, but rather for example to also avoid deformation of the container made of paper, cardboard or the like due to heat and steam, adhesive flanges connected to the inner side of the closing and/or pivot side walls can project from the side ends of the outer wall and/or inner wall sections of the corresponding container halves.

To save material and also to simplify the manufacture, the container can be manufactured from a one-part blank made of paper, cardboard or the like.

A one-part blank of this nature for the manufacture of the container in particular has a bottom and cover section, which are interconnected via their respective pivot side wall sections, wherein the bottom and/or cover section has at least one side wall section with an inner side wall section connected to it and an additional second bottom and/or cover wall section. During the manufacture of the container the corresponding inner side wall sections are folded towards the container interior relative to the outer side wall sections and the second wall sections connected to the inner side wall sections and pertaining to the bottom or cover then form, together with the respective first bottom and/or cover wall section, the corresponding double-walled wall of the container. In addition, the corresponding side walls of the inner and outer side wall sections are double-walled.

If the corresponding second bottom and/or cover wall is not formed as a single part from the bottom and/or cover wall section, there is also the possibility that this section projects from side wall sections opposite each of two inner side wall sections and correspondingly are interconnected during the manufacture of the container with their free ends oriented towards one another.

In order to be able to manufacture the container in a simple manner from the blank, fold lines can be formed between the side wall section and the first bottom and/or cover wall section. They facilitate easy folding of the side wall section upwards opposite the corresponding first bottom and/or cover wall section.

Then in order to be able to also fold the inner side wall section in a simple manner into the container interior, fold lines and in particular also partially cut fold lines can be formed between the said inner side wall section and the second bottom and/or cover wall section and also appropriately to the outer side wall sections.

Partially cut fold lines are in particular conceivable for the connection between the inner side wall section and the respective second bottom and/or cover wall section.

The step-shaped formation of the end sections of the corresponding partial walls of the second bottom and cover walls described in connection with the container can in this way easily be realised during blanking in that on the free end of the second bottom and/or cover wall section a partially cut line and a fold line are formed spaced parallel to one another for the formation of the vertical and horizontal step walls. The partial cutting line is here a fold line, which has been cut through a part of the material thickness, but for example is not perforated or completely cut. This in particular facilitates folding down the vertical step wall in the direction of the first bottom and/or cover wall.

In order to ensure the pivoting feature of the two container halves in a simple manner during blanking, appropriate pivot side wall sections of the side wall sections can have an approximately undulated cutting line along their connecting line and/or pivot line, which is continued in both directions sideways through partially cut lines and then through fold lines. The partially cut lines can be formed as perforations.

In order to provide connecting elements for the detachable closure of the container halves during blanking, a closing side wall section protruding from the first bottom wall section can have a snap-in recess at each of its side ends. An appropriate counter-element of the upper container half can engage in this recess to realise the closed position of the container.

If an above-mentioned adhesive flange is glued onto an inner side of the closing side wall section during the manufacture of the container and if this adhesive flange is glued, in particular for stiffening the container in the edge regions on side ends of the section, a corresponding adhesive flange, in particular with a snap-in recess matching the snap-in recess of the closing side wall section, can project from the outer and/or inner side wall section sideways at least on one side.

A corresponding counter-element can in particular be formed in that the outer and/or inner side wall section of the cover section has at one end a latching protrusion which engages the corresponding snap-in recess with the container closed.

In the following, an advantageous embodiment of the invention is explained in more detail based on the figures enclosed in the drawing.

Figure 2:
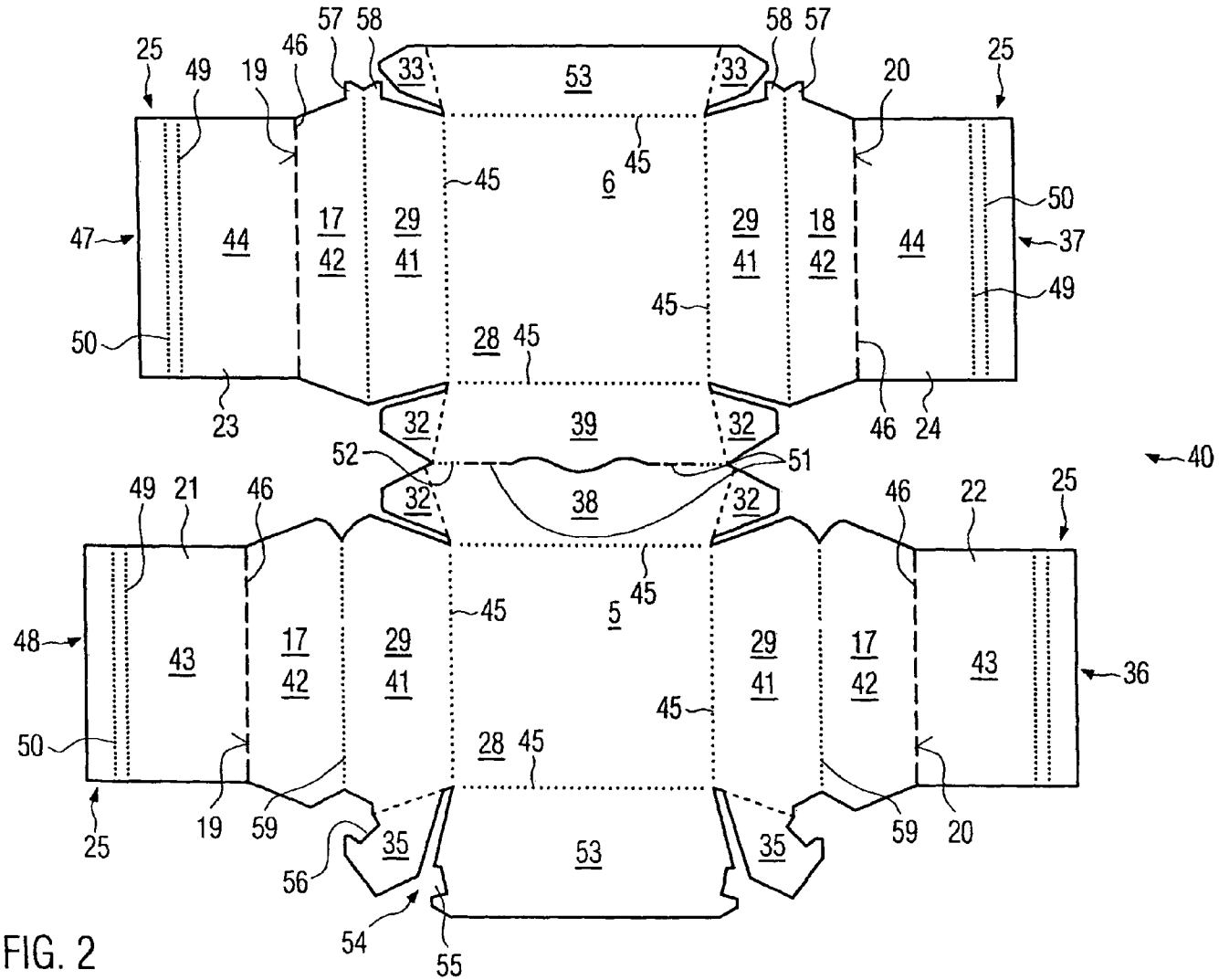

The following are shown:

FIG. 1 an oblique perspective plan view from above onto a container according to the invention in the open position, and FIG. 2 a plan view of a one-part blank for the manufacture of the container according to FIG. 1.

FIG. 1 illustrates an oblique perspective plan view onto a container 1 according to the invention in the open position 4. In the closed position correspondingly an upper container half 2 is folded about a corresponding pivot line 13 onto the lower container half 3 which is open at the top, wherein the corresponding closed position is determined by the engagement of latching hooks 57, 58 projecting from the upper container half 2 in the corresponding snap-in recesses 55, 56 on the lower container half 3.

The upper container half 2 has a cover wall 6, refer also to FIG. 2, which is formed by a flat and essentially square part made of paper, cardboard or the like. From this cover wall 6 corresponding side walls 7, 8, 9, 10 project along all sides obliquely upwards in FIG. 1. The side walls 7 and 8 are formed double-walled from the outer wall section 29, refer to FIG. 2, and the inner wall section 17 respectively 18. The corresponding side walls 7, 8 are interconnected at both ends through the other side walls 9 and 10. The side Wall 9 forms a pivot side wall, which is connected through the corresponding pivot line 13 to a corresponding pivot side wall 9 on the lower container half 3 for pivoting the container halves between the opening and closed positions. Opposite the pivot side wall a closing side wall 10 is arranged, which is assigned to the corresponding closing side wall 10 of the lower container half 3 in the closed position of the container 1. The closing side wall 10 of the upper container half 2 has at its side ends adhesive flanges 32 which are folded towards the inside of container 1 and which appropriately contact the inner sides 31 of the double-walled side walls 7, 8, where they are glued. Corresponding adhesive flanges 32 are similarly provided on the corresponding closing side wall 10 and also glued to the inner sides 31 of the double-walled side walls 7, 8.

This also applies analogously to the closing side wall 10 and pivot side wall 9 of the lower container half 3 with bottom wall 5, wherein however with the lower container half 3 no adhesive flanges project from the closing side wall 10, but rather appropriately from the double-walled side walls 7, 8, refer to the adhesive flange 35 in FIG. 2. In particular, these adhesive flanges 35 project from outer wall sections 29 of the double-walled side walls 8, 9.

The corresponding pivot line 13 for pivoting the two container halves 2, 3 is formed along end edges 11, 12 of the pivot side walls 9 of the respective container half 2, 3. The corresponding pivot line 13 has centrally a sectional line 14 of undulating shape, wherein in FIG. 1 in the open position 4 of the container 1 a wave trough and two wave crests can be seen along the end edge 11 of the pivot side wall 9 of the lower container half 3 and one wave crest can be seen along the end edge 12 of the pivot side wall 9 of the upper container half 2.

In the illustrated embodiment at least the double-walled side walls 7, 8 and also the closing side wall 10 of the lower container half 3 have a greater height than the corresponding side walls of the upper container half 2.

Apart from the double-walled feature of the side walls 7, 8 of both container halves 2, 3, the corresponding bottom wall and/or cover wall is also formed double-walled, refer to the first bottom wall 5 and/or the first cover wall 6 and correspondingly the second bottom wall 15 and the second cover wall 16.

Each of the second walls 15, 16 extends from the lower ends 19, 20 of the respective inner wall section 17, respectively 18 of the opposite double-walled side walls 7, 8. The second walls 15, 16 are formed in pairs by partial walls 21, 22 and 23, 24. These can be easily recognised on the blank 40 in FIG. 2. The partial walls 21 and 22 are interconnected on their end sections 25, which are oriented to one another, for the formation of the second bottom wall 15.

The joint can be realised in one embodiment by direct gluing of the corresponding end sections 25, wherein a corresponding air space or an air chamber is provided between the first and second bottom walls over the complete extent of these walls.

In the embodiment according to FIG. 1 approximately centrally in the second bottom wall 15 and correspondingly in the second cover wall 16 a groove or a trough is formed which has an approximately rectangular cross-section, wherein a longer side of the rectangle is formed by a horizontal step wall 27 and a shorter side of the rectangle by a vertical step wall 26 of each partial wall. The vertical step walls 26 each extend essentially between the two bottom and/or cover walls and the correspondingly horizontal step walls extend parallel to them and are interconnected and in one embodiment also connected to the first bottom and/or cover wall 5, 6, in particular, by gluing.

On the corresponding side ends 30, in particular of the closing side wall 10, the snap-in recesses 55, 56 are formed, refer also to FIG. 2, to which in the closed position of the container 1 the latching hooks 57, 58, arranged on the extension of the outer wall sections 29 and inner wall sections 17, 18 of the corresponding double-walled side walls 7, 8, are assigned.

A maximum open position of the container 1 is determined by the contact of the outer sides of the pivot side walls 9 which are oriented to one another and pertain to the upper and lower container halves 2, 3.

In a further embodiment the side walls and in particular the closing side walls 10 do not extend flat from the upper and lower container halves 2, 3, but are rather bent in a concave manner to the container interior so that they extend centrally in the longitudinal direction of each of these closing side walls furthest into the container interior. This is shown in broken lines in FIG. 1 for the closing side wall 10 of the lower container half 3.

In FIG. 2 a plan view onto a one-part blank 40 is illustrated for the manufacture of the container 1 according to FIG. 1, wherein here the same parts are identified by the same reference numerals.

The blank 40 has a bottom section 36 and a cover section 37. After folding and joining the corresponding blank parts, the bottom section 36 forms the lower container half 3 and correspondingly the cover section 37 forms the upper container half 2 according to FIG. 1.

The bottom section 36 comprises centrally an approximately square container bottom 5, which forms a first bottom wall. Along its circumference, this is joined by fold lines 45 to outer side wall sections 41, a pivot side wall section 38 and a closing side wall section 53. With the container 1 according to FIG. 1, the pivot side wall section 38 forms correspondingly the pivot side wall 9 and the closing side wall section 53 the closing side wall 10.

The pivot side wall section 38 is separated from the corresponding pivot side wall section 39 of the cover section 37 by a central sectional line 14, refer also to FIG. 1, which is formed undulated. On both side ends this sectional line 14 is continued by partially cut or perforated fold lines 51 and then by further fold lines 52. On both side ends of the corresponding pivot side wall sections 38, 39 adhesive flanges 32 are arranged, refer also to FIG. 1, which can contact corresponding inner sides of the double-walled side walls 7, 8 where they can be glued.

The closing side wall section 53 has the snap-in recesses 55 at its free or side ends 54.

To the right and left in FIG. 2, first the outer side wall section 41, then the inner side wall section 42 and then the corresponding second bottom wall section 43 is arranged to the first bottom wall 5. Along corresponding fold lines 45, 59, on one hand folding of the outer side wall section 41 upwards occurs, then folding in of the inner side wall section 42, refer also to FIG. 1, and then an arrangement of the second bottom wall section 43 parallel to the first bottom wall 5 occurs. This also occurs analogously on the other side of the first bottom wall 5 in FIG. 2, wherein furthermore adhesive flanges 35 projecting sidewards at one end 34 of the outer side wall sections are folded inwards and contact a corresponding inner side 38 of the closing side wall section 53, where they are glued, refer again to FIG. 1.

The two second bottom wall sections 43 according to FIG. 2 form the corresponding partial walls 21, 22 according to FIG. 1, which are glued together at their free ends 48 which are oriented to one another or corresponding end sections 25. Here, first a vertical step wall 26, refer to FIG. 1, is bent over by folding along the partially cut fold line 49 in the direction of the first bottom wall 5 and then the horizontal step wall 27 is arranged through the fold line 45 parallel to the first bottom wall 5. The corresponding horizontal step walls 27 of the mutually assigned partial walls 21, 22 are glued together and also to the first bottom wall 5.

The construction of the cover section 37 is analogous, as is the folding of the corresponding parts, such as the pivot side wall section 39, outer side wall section 41, inner side wall section 42, second cover wall section 44 with the respective corresponding partially cut fold lines, fold lines 45, 46, 49, 50 and the like. In contrast to the bottom section 36 the cover section 37 has corresponding adhesive flanges 33 on side ends of the closing side wall section 53. Referring also to FIG. 1, these contact corresponding inner sides of the inner side wall sections 42 and/or the inner wall sections 17 and 18, where they are glued.

In addition, the corresponding inner and outer side wall sections 41, 42 have at one end the latching hooks 57, 58, which with the manufactured container according to FIG. 1 essentially form a latching hook 57, 58, which engages the corresponding snap-in recess 55, 56.

As can be seen from the bottom section 36, the snap-in recess 55, 56 is composed on one hand of the snap-in recess 55 of the closing side wall section 53 and on the other hand of the snap-in recess 56 of the adhesive flange 35. This is arranged and fixed on the inner side of the closing side wall section 53 on the container according to FIG. 1 such that the corresponding snap-in recesses 55, 56 are arranged without overlap and correspondingly fit together.

There is also the possibility that the corresponding trough or groove in the second bottom wall 15 and/or second cover wall 16 can be omitted in that the corresponding end sections 25 and/or ends 47, 48 of the partial walls 21, 27 are directly connected and only to one another. In this way, this region of the corresponding second walls of the bottom and cover has no contact with each of the respective first walls 5, 6. This applies at least as long as an appropriate foodstuff such as a hamburger or the like is placed in the container and it is not too heavy. However, the stiffness of the container is increased by the corresponding trough, as also by the arrangement of the double-walled side walls or double-walled walls on the bottom or cover.

The container according to the invention is characterised in particular by an increase in stiffness which avoids corresponding deformation during the handling of the container with or without foodstuff. This is in particular provided by the double-walled bottom and the corresponding part of the cover. At the same time the double-walled regions also provide improved thermal insulation so that the appropriate foodstuff, such as hamburger, sandwich or the like remains warm or optionally cooler longer. Due to the stiffening of the container, in particular with a container of this nature made of paper, cardboard or the like, there is less deformation than would otherwise occur with appropriate heat and steam.

The invention claimed is:

1. A container for transporting food, comprising an upper and a lower container half, which are pivotably interconnected so as to pivot between a closed and an open position, one container half comprising a flat bottom and the other container half comprising a flat cover wall, both of the container halves further comprise side walls extending from said bottom or cover wall essentially obliquely upwards or downwards and outwards to the respective other container half, wherein the bottom or cover wall is double-walled at least in places;

wherein two of the sidewalls that are opposite one another and that are adjoined to one another by another of the sidewalls that connects the container halves are double-walled, wherein to form said double-walled bottom wall or said double-walled cover wall, a second bottom wall or a second cover wall extends between the two opposite double-walled sidewalls, wherein the second bottom wall or the second cover wall is connected to lower ends of inner wall sections of said opposite double-walled sidewalls, wherein said inner wall sections are folded towards an interior of the container, wherein said lower ends of the inner wall sections are arranged spaced apart from the bottom or cover wall to form at least in regions an air chamber between the bottom and the second bottom or the cover wall and the second cover wall, respectively.

2. The container according to claim 1, wherein one of the side walls of the upper container half and one of the side walls of the lower container half which face one another are pivotably interconnected as pivot side walls with the formation of a pivot line.

3. The container according to claim 1, wherein the pivot line has a central sectional line.

4. The container according to claim 3, wherein the sectional line is substantially undulated.

5. The container according to claim 1, wherein the second bottom wall and the second cover wall are formed from two interconnected partial walls projecting from respective ones of the inner wall sections that are opposite one another.

6. The container according to claim 5, wherein the interconnected partial walls are interconnected along end sections oriented towards one another.

7. The container according to claim 6, wherein the end sections are made step-shaped from substantially vertical and horizontal step walls, said horizontal step walls of the end sections being interconnected.

8. The container according to claim 7, wherein at least one of the horizontal step walls is in contact with and glued to an inner side of the corresponding bottom and/or cover wall.

9. The container according to claim 8, wherein one of the side walls that is opposite to the pivot side wall is formed as a closing side wall, said side wall detachably connecting the lower container half in the closed position to the upper container half.

10. The container according to claim 9, wherein adhesive flanges connected to inner sides of one or more of the side walls project from lateral ends of the pivot side wall and/or the closing side wall.

11. The container according to claim 10, wherein at least the closing side wall of the lower container half and the corresponding side wall of the upper container half are curved concavely inwards.

12. The container according to claim 11, wherein adhesive flanges connected to the inner side of the closing and/or pivot side wall project from lateral ends of the outer wall and/or inner wall section of the corresponding double-walled side walls.

13. The container according to claim 1, wherein the container is made from a one-part blank.

14. A one-part blank for producing a container according to claim 13, comprising a bottom and a cover section which are interconnected via respective pivot side wall sections, wherein at least the bottom and/or cover section comprises at least one side wall section with an inner side wall section adjoining the same and with a second bottom and/or cover wall section.

15. The blank according to claim 14, wherein the second bottom and/or cover wall sections extend from inner side wall sections of opposite side wall sections.

16. The blank according to claim 15, wherein fold lines are formed between each of the side wall sections and a first bottom or cover wall section.

17. The blank according to claim 16, wherein partly cut fold lines are formed between each of the inner side wall sections and the second bottom and/or or cover wall section.

18. The blank according to claim 17, wherein at a respective edge of each of the second bottom and/or cover wall sections, a partial cutting line and a fold line are respectively formed for forming vertical and horizontal step walls.

19. The blank according to claim 18, wherein an approximately undulated sectional line is formed between the pivot side wall sections at least partially along a connection line thereof, said sectional line being continued in both directions laterally by partly cut fold lines and then by fold lines.

20. The blank according to claim 19, wherein one of the side walls has a closing side wall section which projects from the first bottom wall section and comprises a respective snap-in recess at the free lateral ends of the closing side wall section.

21. The blank according to claim 20, wherein an adhesive flange with a snap-in recess matching the snap-in recess of the closing side wall section projects from an outer or inner of the side wall sections laterally at least on one side.

22. The blank according to claim 21, wherein the outer and/or inner side wall section of the cover section comprises a locking hook at one end.

* * * * *